US012195687B1

(12) United States Patent
Koh et al.

(10) Patent No.: US 12,195,687 B1
(45) Date of Patent: Jan. 14, 2025

(54) APPARATUS FOR A REFORMED FUEL MANUFACTURING AND METHOD USING THE SAME

(71) Applicants: James Chun Koh, Fort Lee, NJ (US); Shinji Hasegawa, Tokyo (JP)

(72) Inventors: James Chun Koh, Fort Lee, NJ (US); Shinji Hasegawa, Tokyo (JP)

( * ) Notice: Subject to any disclaimer, the term of this patent is extended or adjusted under 35 U.S.C. 154(b) by 30 days.

(21) Appl. No.: 18/238,468

(22) Filed: Aug. 26, 2023

(51) Int. Cl.
*C10L 1/32* (2006.01)

(52) U.S. Cl.
CPC ..... *C10L 1/328* (2013.01); *C10L 2200/0295* (2013.01); *C10L 2290/54* (2013.01)

(58) Field of Classification Search
CPC ..... C10L 1/328; C10L 2200/0295; C10L 2290/54
See application file for complete search history.

(56) References Cited

U.S. PATENT DOCUMENTS 10,947,469 B2 3/2021 Koh
2012/0240875 A1 9/2012 Tan

FOREIGN PATENT DOCUMENTS

JP 2011-038000 A 2/2011

*Primary Examiner* — Randy Boyer
*Assistant Examiner* — Juan C Valencia
(74) *Attorney, Agent, or Firm* — LEEPI

(57) ABSTRACT

A reformed fuel manufacturing apparatus and method is provided, including a water tank unit configured to pretreat a water introduced therein by using a carbon filter and a reverse osmosis purifier, the water is additionally pretreated by applying voltage therein with an electrolysis device, an oil tank unit configured to store an oil introduced from an oil inlet, a mixed oil unit connected to the water tank unit and the oil tank unit and configured to produce a mixed oil by using an inline mixer, and an ionization catalyst unit connected to the mixed oil unit and configured to convert the mixed oil to a reformed fuel.

15 Claims, 7 Drawing Sheets

APPARATUS FOR A REFORMED FUEL MANUFACTURING AND METHOD USING THE SAME

FIELD OF THE INVENTION

The various embodiments described herein pertain generally to an apparatus for reformed fuel manufacturing from various types of oils and a method using the same.

BACKGROUND OF THE INVENTION

Recently, exhaustion of fossil fuel and generation of greenhouse gases have arisen as worldwide problems.

To solve the issue, Korean Patent No. 101328151 describes a method and apparatus for manufacturing an emersion fuel that can be atomized and exhibits high applicability. In this method and apparatus, water and oil fuel such as diesel, kerosene or heavy oil are supplied into a space to which a magnetic field is applied. In that space, the water and the oil fuel are atomized and mixed with each other, so that an emersion fuel is produced.

In such a conventional fuel manufacturing method and apparatus, however, since the fuel is in the form of emersion, water-oil separation may occur, and a water component may be left. Therefore, a flash point would be greatly increased, whereas calorific power would be decreased, resulting in a failure to reduce the consumption of the fossil fuel substantially.

To resolve this problem, the present inventor has filed and received a grant for Korean Patent No. 101581235 (titled "Apparatus for Manufacturing a Reformed Fuel and a Method for Manufacturing the Same"). In this method and apparatus, water is atomized by applying an ultrasonic wave, and hydrogen peroxide is decomposed by supplying enzyme from an enzyme tank. Accordingly, water and oil are allowed to be easily mixed with each other without separation. Thus, it is possible to suppress the problems of the reformed fuel in the form of emersion, such as an increase of a flash point and a decrease of a calorific power.

However, its apparatus and method for manufacturing a reformed fuel involves a complicated process, and there is difficulty in managing enzyme in the enzyme tank. Further, since the apparatus has a complicated structure adapted to apply the ultrasonic wave and the electric field, manufacturing cost is high, and repair and maintenance of the apparatus is not easy. Also, in the process of producing and selling the actual system, there is a realistic problem that it is difficult to make a catalyst corresponding to the different additives added to the fuel in each country.

U.S. Pat. Nos. 10,947,469 and 11,584,894 presented by the same inventor suggested a new methodology of manufacturing bio-emulsion fuel using vegetable oil. The oil from cashew nut husk is considered a waste but recently got new attention as a raw material for the reformed fuel due to its cost effectiveness.

The present invention represents the refinement of the apparatus in U.S. Pat. Nos. 10,947,469 and 11,584,894 by adding more features in the manufacturing process in addition to previously disclosed items. The newly added features result in increasing the effectiveness of the manufacturing process and enhancing the quality of bio-emulsion fuel as a final product.

SUMMARY

In view of the foregoing problems, the example embodiments provide an apparatus and method for manufacturing a reformed fuel using any types of oil containing different additives in each country.

In accordance with a first aspect of an illustrative embodiment, there is provided a reformed fuel manufacturing apparatus including a water tank unit configured to pretreat a water introduced therein by using a carbon filter and a reverse osmosis purifier; the water is additionally pretreated by applying voltage therein with an electrolysis device; an oil tank unit configured to store an oil introduced from an oil inlet; a mixed oil unit connected to the water tank unit and the oil tank unit and configured to produce a mixed oil by using an inline mixer; and an ionization catalyst unit connected to the mixed oil unit and configured to convert the mixed oil to a reformed fuel.

In accordance with the first aspect of the illustrative embodiment, there is provided a reformed fuel manufacturing method including, preparing a pretreated water by a carbon filter and a reverse osmosis purifier located along an inlet of water supply; Additionally pretreating the water by applying a voltage with an electrolysis device inside the water tank unit; preparing an oil by storing the oil into an oil tank; producing a mixed oil from the pretreated water introduced from the water tank unit and the oil introduced from the oil tank unit by the use of an inline mixer; and converting the mixed oil to a reformed fuel with an ionization catalyst unit.

According to the above-mentioned problem-solving method of the present invention, the reformed fuel using various types of oils generates heat higher in combustion than that of the emulsion fuel by the conventional fossil fuel.

Also, the reformed fuel has reduced pollutant emission due to its characteristics of emulsion fuel.

BRIEF DESCRIPTION OF THE DRAWINGS

In the detailed description that follows, embodiments are described as illustrations only since various changes and modifications will become apparent from the following detailed description. The use of the same reference numbers in different figures indicates similar or identical items.

FIG. 1 is divided into FIG. 1(*a*), FIG. 1(*b*) to represent detailed entities.

DETAILED DESCRIPTION

Figure 1A:
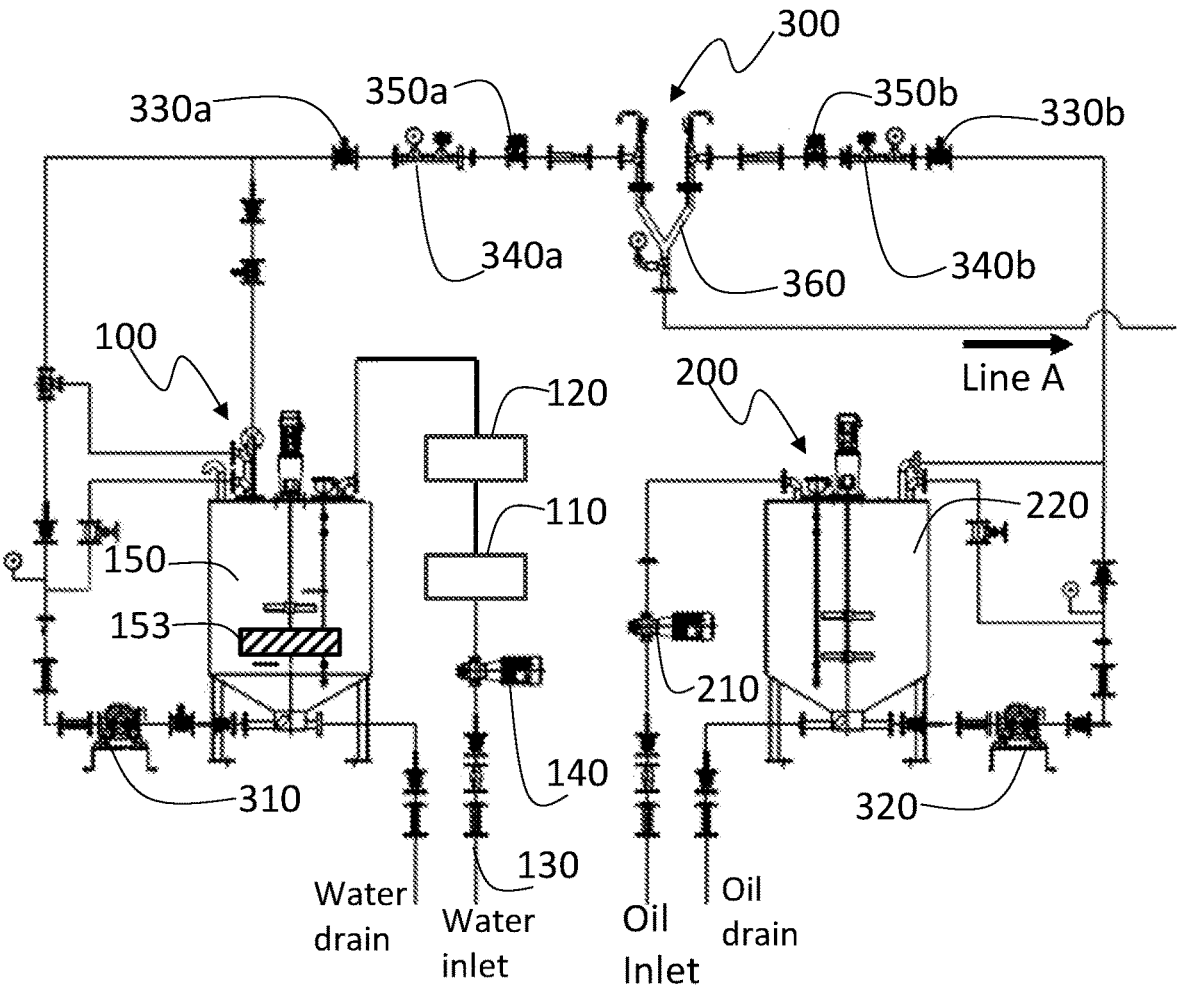
FIG. 1 is a process flowchart of a reformed fuel manufacturing apparatus in accordance with an example embodiment to explain how the reformed fuel is produced through the present invention.

Hereinafter, example embodiments will be described in detail so that inventive concept may be readily implemented by those skilled in the art. However, it is to be noted that the present disclosure is not limited to the illustrative embodiments and examples but can be realized in various other ways. In drawings, parts not directly relevant to the description are omitted to enhance the clarity of the drawings, and like reference numerals denote like parts through the whole document.

Through the whole document, the term "on" that is used to designate a position of one element with respect to another element includes both a case that the one element is adjacent to another element and a case that any other element exists between these two elements.

Through the whole document, the term "comprises or includes" and/or "comprising or including" used in the document means that one or more other components, steps, operation and/or existence or addition of elements are not excluded in addition to the described components, steps, operation and/or elements unless context dictates otherwise. The term "about or approximately" or "substantially" are intended to have meanings close to numerical values or ranges specified with an allowable error and intended to prevent accurate or absolute numerical values disclosed for understanding of the present disclosure from being illegally or unfairly used by any unconscionable third party. Through the whole document, the term "step of" does not mean "step for".

Hereinafter, example embodiments will be described in detail with reference to the accompanying drawings, which form a part hereof.

First, a reformed fuel manufacturing apparatus 10 (hereinafter, referred to as "the present reformed fuel manufacturing apparatus 10") in accordance with an example embodiment will be elaborated.

Figure 1B:
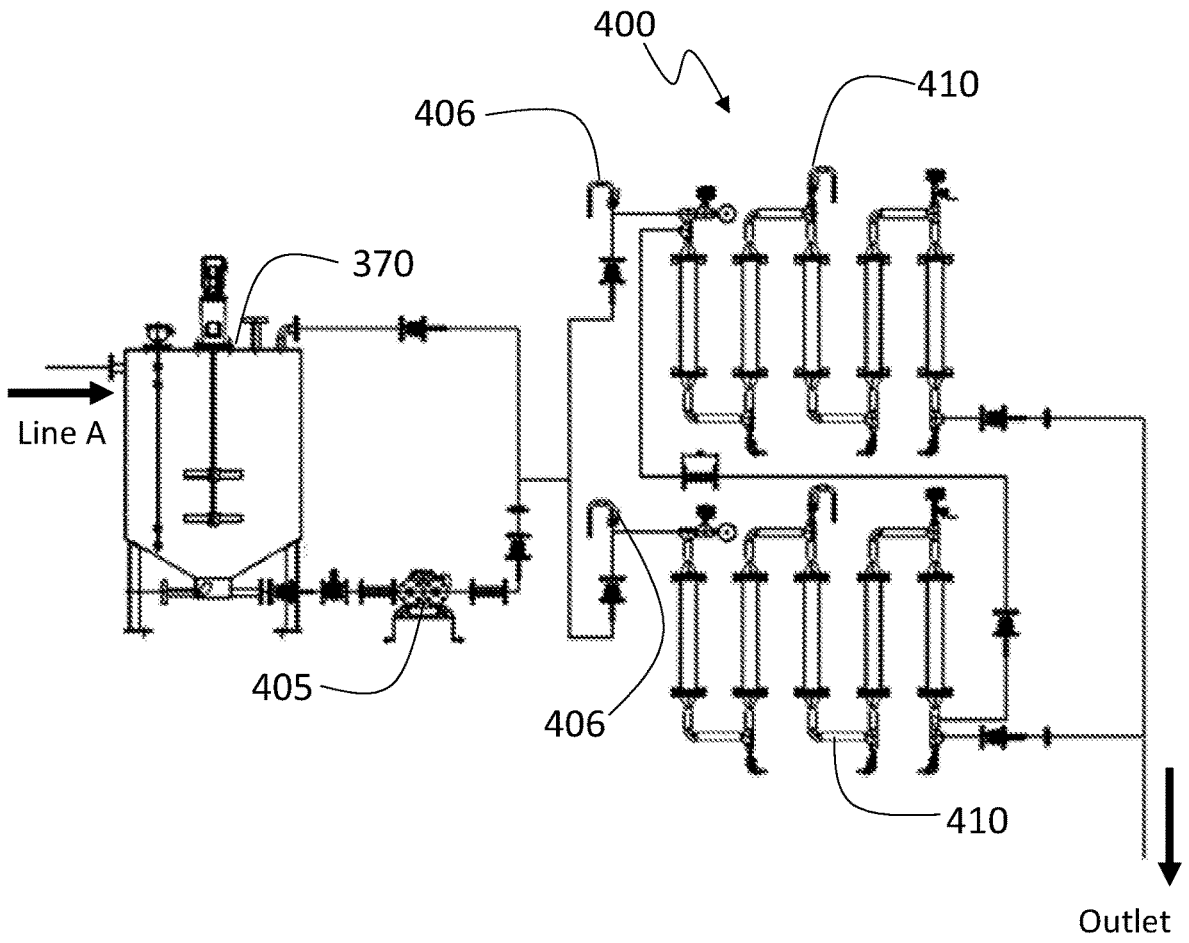

Referring to FIGS. 1(*a*) and (*b*), a configuration of the present reformed fuel manufacturing apparatus 10 will be explained.

As depicted in FIG. 1, the present reformed fuel manufacturing apparatus 10 includes a water tank unit 100, an oil tank unit 200, a mixed oil unit 300 and an ionization catalyst unit 400.

The water tank unit 100 is configured to pretreat water introduced therein by using a carbon filter 110 and a reverse osmosis purifier 120 installed along an inlet of a water main supply line 130. Through this line 130, the water tank unit 100 may be supplied with water from a water supplying pump 140. The pretreated water by the carbon filter 110 and the reverse osmosis purifier 120 is stored in a water tank 150. The water tank is further equipped with an electrolysis device 153 therein. The electrolysis device 153 is submerged in the water inside the water tank 150 and it additionally pretreats water by applying the voltage therein.

The technical background for the purpose of water pretreatment is explained as follows.

Hydrogen is an alkane reduction of C n H 2n+2, and the oxidation of $H_2O$. This is a technology that additives ($H_2O$) are added to alkanes by oxidizing added water (a molecule called $H_2O$), using the oxidized $H_2O$ as a reducing agent, and reducing an alkane fuel with about 10 to 20 carbon atoms (C). Alkanes are expressed to $CH_3+(CH_2+CH_2+ \ . \ . \ . \ +CH_2)+CH_3$. For example, if cetane ($C16H34=CH_3(CH_2)14CH_3$ is reduced (in the chemical formula), then it becomes 2×octane ($C_8H18=CH_3(CH_2)_6CH_3$). This reaction does not occur naturally. The beauty of the presented apparatus is to enable reactions that do not normally occur. There are various methods for the redox reaction of water ($H_2O$), but the one adopted in this system is the electrolytic treatment method. So-called electrolysis.

Normally, when water ($H_2O$) is applied to the electrode, anode and cathode, an oxidation reaction occurs on the anode side and a reduction reaction occurs on the cathode side, and oxygen ($O_2$) is released from the anode to the cathode. It is already known that hydrogen ($H_2$) is generated from;

$$2H_2O+2e^-=H_2+2OH^-(0.41V)$$

This system makes the water of the additive an effective reducing agent by adjusting (reforming) the electrolyte (water) used by subjecting the electrode to special treatment. This system mixes the reducing agent, which has undergone transition in a very short time, to alkanes at a suitable pressure and flow rate (suitable contact time), and after mixing, passes through various types of catalysts at an appropriate pressure to stop the re-reaction of the mixed solution and the system is complete.

In conclusion, water ($H_2O$) is a molecule that creates molecular crystals with only a small number of them. In the impurities (components) of water (raw water), there are components that promote the reaction, components that hinder it, and components that retain it. The catalytic reaction is necessary for both water and mixed liquid.

In this system, the reduction of alkanes is a reduction reaction using water (raw water) as a raw material, modifying water, and subjecting an ion effect generated from a specially processed electrode to an electrolytic treatment liquid as a nucleophile.

A compound in which hydrogen on a carbon of a hydrocarbon other than the benzene ring of an alkane is substituted with a hydroxyl group is called alcohol, and a compound in which hydrogen in a benzene ring is substituted with a hydroxyl group is called phenol. In the water product ion (OH) hydroxy (hydroxy) is generated.

In this system, hydroxy and neutral radical (·OH); Hydroxycal is a component that greatly interferes with the reaction, but it is necessary to obtain a component supplementing this from raw water.

In general, a chemical substance added for the purpose of stopping a chain reaction or decomposition is called a scavenger, but it is excluded if the raw water contains a component obtained from raw water and interfering with it.

Since the reaction system occurs in a very short period and in a unique environment, it is essential to analyze the raw water components to remove interfering components, and to add deficient components that distinguish between buffering components and accelerating components.

| | NaBH4 | LiBH4 | LiAlH4 | BH3 |
|---|---|---|---|---|
| (aldehyde) | ◎ | ◎ | ◎ | ○ |
| (ketone) | ◎ | ◎ | ◎ | ○ |
| (ester) | ○ | ◎ | ◎ | ○ |
| (amides) | X | X | ◎ | ◎ |
| (Carboxylic acid) | X | X | ○ | ◎ |

◎: Reversible
○: Reversible slowly
X: Non-reversible

To validate the pretreatment of water is the measurement of pH and Oxidation Reduction Potential (ORP) of the water after carbon filtering, reverse osmosis purification and electrolysis. The desired value of pH should be 6-6.5, and ORP be −265~−275 to confirm the water is pretreated.

The oil tank unit 200 may be supplied with any type of oil through an oil supplying pump 210. The provided oil is temporarily stored in an oil tank 220.

The mixed oil unit 300 is connected to the water tank unit 100 and the oil tank unit 200. The mixed oil unit 300 generates a mixed oil, configured to physically mix the pretreated water transferred from the water tank unit 100 and the oil from the water tank unit 200 by using an inline mixer 360.

More specifically, the pretreated water inside the water tank 150 is transferred to the inline mixer 360 through a high-pressure water pump 310. Also, the oil inside the oil tank 220 is transferred to the inline mixer 360 simultaneously through a high-pressure oil pump 320. Each conduit line between tanks 150, 220 and inline mixer 360 includes a control valve 330*a*, 330*b* configured to control the amount of water and oil that goes into the inline mixer 360 respectively. The mixture ratio of the refined oil and the pretreated water is determined by the adjustment of the control valve 330*a*, 330*b*. The preferred ratio between the refined oil and the pretreated water is normally set to 1:1 and could be 6:4 or 7:3 based on the operating condition. In addition, each conduit line between tanks 150, 220 and inline mixer 360 further includes a pressure gage 340*a*, 340*b* and a flow gage 350*a*, 350*b* to monitor the pressure and flow rate of each pretreated water and oil that goes into the inline mixer 360. The data from the pressure gage 340*a*, 340*b* and the flow gage 350*a*, 350*b* are sent to a main controller (not shown in the FIGS) to automatically adjust the ratio in a precise way.

The mixed oil physically mixed by the inline mixer 360 is transferred to a mixed oil tank 370 and temporarily stored therein.

The ionization catalyst unit 400 is connected to the mixed oil unit 300. The ionization catalyst unit 400 is configured to generate a reformed fuel from the mixed oil by using an ionization catalyst group.

Figure 2:
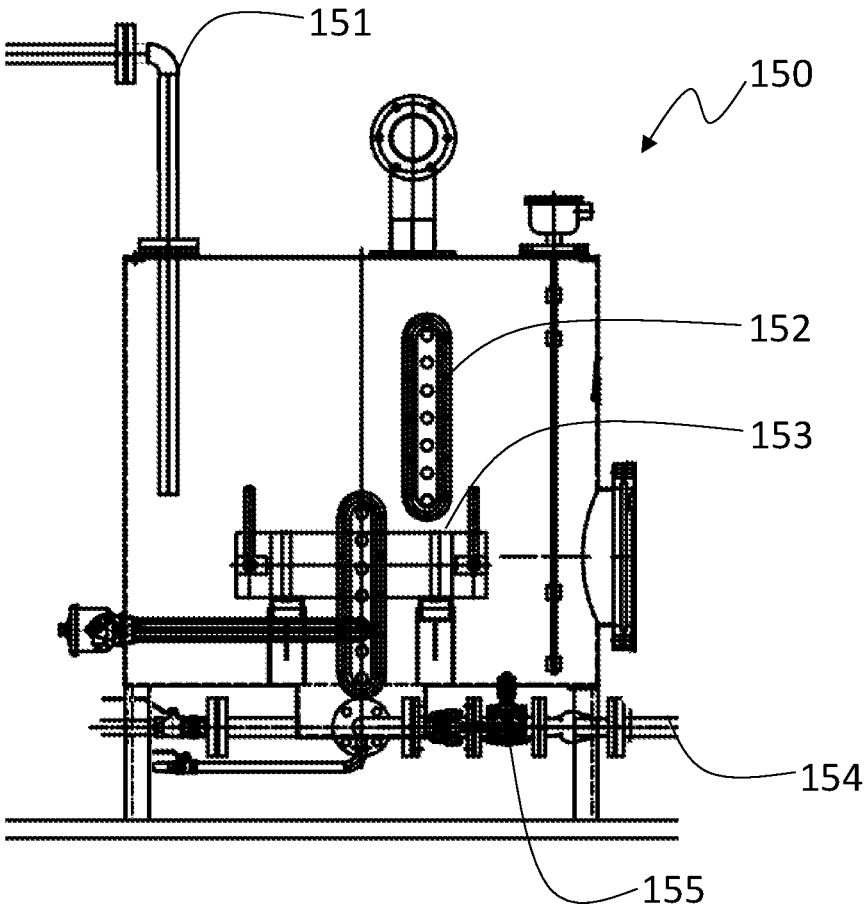
FIG. 2 is a schematic side view of a water tank in accordance with the example embodiment.

Referring to FIG. 2, the water tank 150 in accordance with the example embodiment will be elaborated in detail.

The water tank 150 includes a water inlet line 151, a water level measurer 152, an electrolysis device 153, and a water outlet line 154.

The water inlet line 151 delivers the pretreated water by the carbon filter 110 and the reverse osmosis purifier 120 into the water tank 150 through a water supplying pump 140.

The water level measurer 152 is configured to measure a water amount, i.e., a water level within the water tank 150.

The water level information obtained by the water level measurer 152 may be sent to the main controller (not shown). The main controller adjusts the water level within the water tank 150 by checking the water level information and controlling operation of the water supplying pump 140.

The electrolysis device 153 additionally pretreats the water inside the water tank 150 by applying the voltage therein. By way of example, the electrolysis device 153 is located at a central portion, e.g., a lower central portion within the water tank 150.

The water outlet line 154 delivers the pretreated water into the mixed oil unit 300 to be described later. For example, the pretreated water may be transferred into the water outlet line 154 through a water outlet control valve 155 provided at a lower portion of the water tank 150.

Completion of the pretreatment of the water may be determined by the main controller. Further, the main controller may also control the opening and closing of the water outlet control valve 155.

Figure 3:
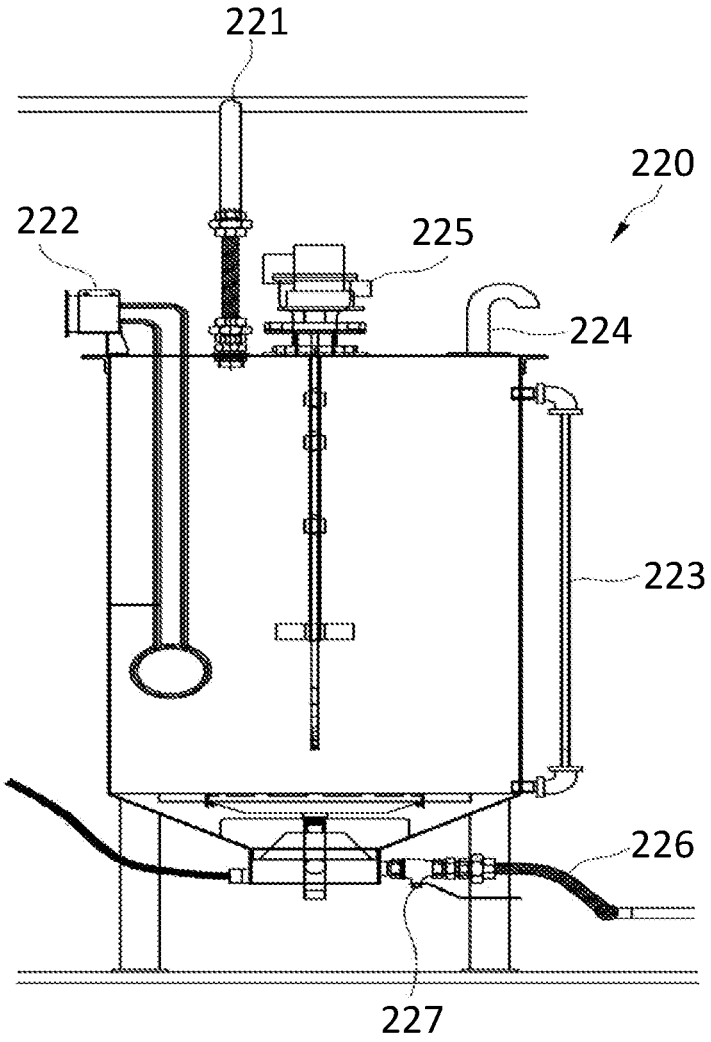
FIG. 3 is a schematic side view of an oil tank in accordance with the example embodiment.

Referring to FIG. 3, the oil tank 220 in accordance with the example embodiment will be elaborated in further detail.

The oil tank 220 includes an oil inlet line 221, an oil heater 222, an oil level measurer 223, an air vent 224, an oil agitator 225, and an oil outlet line 226.

The oil inlet line 221 delivers oil from the outside into the oil tank 220 through the oil supplying pump 210.

The oil heater 222 is provided to maintain an ideal temperature therein. By way of non-limiting example, the ideal temperature inside the oil tank 220 may be, e.g., about 50° C.

The oil level measurer 223 is configured to measure an oil level within the oil tank 220.

The oil level information obtained by the oil level measurer 223 may be sent to the main controller (not shown). The main controller adjusts the oil level within the oil tank 220 by checking the oil level information and controlling operation of the oil supplying pump 210.

The air vent 224 is provided to prevent a pressure rise within the oil tank 220. The air vent 224 may be implemented by a pipe through which the air within the oil tank is exhausted.

The oil agitator 225 is configured to agitate the oil within the oil tank 220. By way of example, the oil agitator 225 may be an oil agitating motor, which may be installed at an upper central portion of the oil tank 220. As the oil inside the oil tank 220 is agitated by the oil agitator 225, the temperature distribution throughout the oil is constantly maintained.

The oil outlet line 226 delivers the oil into the mixed oil unit 300 to be described later. For example, the oil may be transferred into the oil outlet line 226 through an oil outlet control valve 227 provided at a lower portion of the oil tank 220.

The completion of the oil transfer may be determined by the main controller. Further, the main controller may also control the opening and closing of the oil outlet control valve 227.

Back to referring to FIG. 1(*a*), a process of transferring the pretreated water the oil into the mixed oil unit 300, and a process of mixing the refined oil and the pretreated water will be further explained more in detail.

The pretreated water in the water tank 150 then is transferred to the inline mixer 360 in a pressurized way through the high-pressure water pump 310. The amount of the pretreated water is determined by the control valve 330*a*. The pretreated water passes through the pressure gage 340*a* and the flow gage 350*a* installed along the conduit line between the water tank 150 and the inline mixer 360.

The oil inside the oil tank 220 is transferred to the inline mixer 360 in a pressurized way through the high-pressure oil pump 320. The amount of the oil is determined by the control valve 330*b*. The oil passes through the pressure gage 340*b* and the flow gage 350*b* installed along the conduit line between the oil tank 220 and the inline mixer 360.

The pressure gage 340*a*, 340*b* and the flow gage 350*a*, 350*b* are respectively configured to measure a pressure, flow rate of the pretreated water and the oil. The main controller may adjust a ratio between the pretreated water and the oil using a value or the like based on measurements of the pressure gage 340*a*, 340*b* and the flow gage 350*a*, 350*b*.

Desirably, a ratio between the refined oil and the pretreated water supplied into the inline mixer 360 may be about 1:1 and may be adjusted to 6:4 or 7:3 according to operating condition.

The inline mixer 360 is formed to Y shape. That is, the conduit line from the water tank 150 and the conduit line from the oil tank 220 is joined to the inline mixer 360 as a single line. The inline mixer 360 may have a multiple number of protrusions on an inner surface thereof, generating turbulence to the medium inside. The pretreated water and the oil that meet together inside the inline mixer are physically mixed effectively while they pass through.

Figure 4:
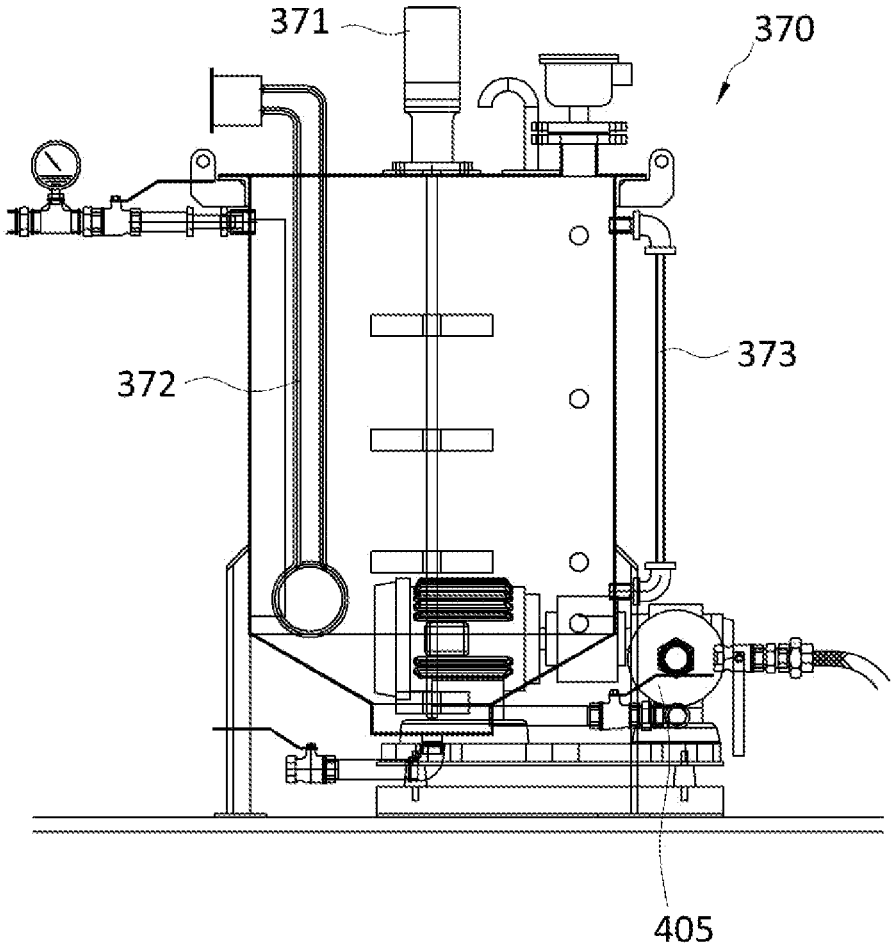
FIG. 4 is a schematic side view of a mixed oil tank in accordance with the example embodiment.

Referring to FIG. 4, the mixed oil tank 370 in accordance with the example embodiment will be described in detail.

The mixed oil tank 370 in accordance with the example embodiment is configured to store the mixed oil from the inline mixer 360.

For the purpose, the mixed oil tank 370 includes a mixed oil agitator 371, a mixed oil heater 372, and a mixed oil level measurer 373.

The mixed oil agitator 371 is configured to agitate the mixed oil introduced into the mixed oil tank 370 such that physically mixed status is maintained effectively. By way of example, the mixed oil agitator 371 may include a motor at an upper portion thereof; and a blade configured to mix the oil and the water. The blade may be rotated at, but not limited to, about 250 rpm to mix the oil and the water uniformly.

For example, the mixed oil may stay in the mixed oil tank 370 for about 5 minutes or less, during which the mixed oil may be more uniformly mixed by the agitating operation of the mixed oil agitator 371.

The mixed oil heater 372 may be configured to maintain a temperature of the mixed oil within a preset range to allow the constant temperature inside the mixed oil tank 370. Desirably, the temperature of the mixed oil may be maintained in the range from, e.g., about 25° C. to about 35° C.

The mixed oil level measurer 373 is configured to measure a level of the mixed oil. A measurement result of the mixed oil level measurer 373 is continuously monitored by the main controller (not shown). The main controller may control an inflow and an outflow of the mixed oil based on this measurement result.

Figure 5:
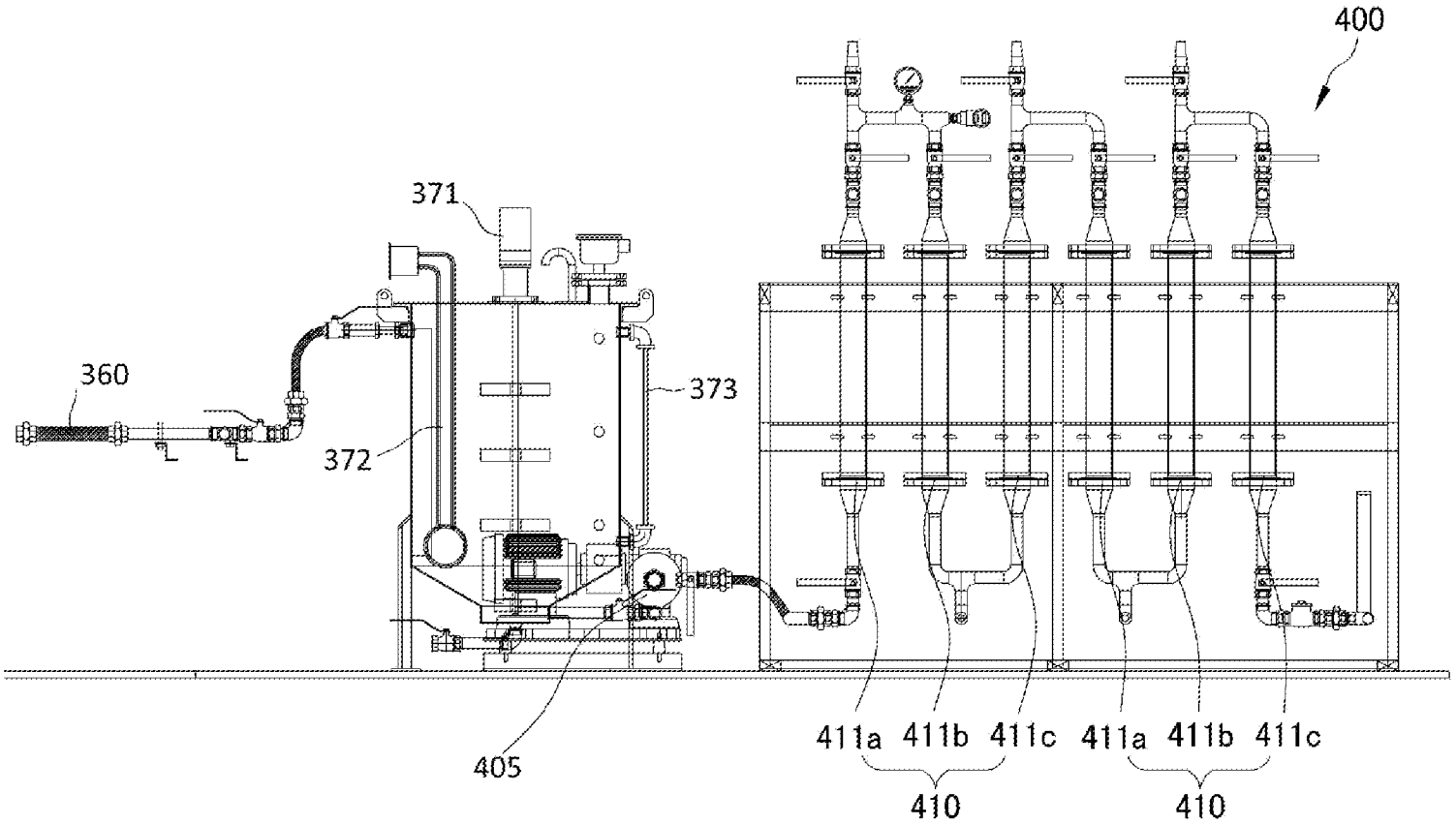
FIG. 5 is a schematic side view of an ionization catalyst unit with the example embodiment; and, FIG. 6 is a flowchart describing the reformed fuel manufacturing method in accordance with the example embodiment.

Referring to FIG. 5, the ionization catalyst unit 400 in accordance with the example embodiment will be described in detail.

A mixed oil pump 405 is configured to transfer the mixed oil in the mixed oil tank 370 to the ionization catalyst unit 400 to be described in detail below. For example, the mixed oil pump 405 may be configured to supply a regular amount of mixed oil to the ionization catalyst unit 400 continuously. Further, the mixed oil pump 405 may be implemented by, but not limited to, a trochoid pump. The mixed oil pump feeds the mixed oil to the ionization catalyst groups at 0.5 MPa pressure.

The ionization catalyst unit 400 may include one or more ionization catalyst group 410, and each ionization catalyst group 410 may include a multiplicity of ionization catalyst cartridge 411.

In a configuration where a plurality of ionization catalyst groups 410 is provided, these ionization catalyst groups 410 may be connected to each other in series or in parallel to allow the mixed oil to pass through an ionization catalyst repeatedly. For example, the ionization catalyst groups 410 may be connected in series or in combination of in series and in parallel.

By way of example, referring to FIG. 1(*b*) and FIG. 5, twelve ionization catalyst cartridges 411 are connected in combination of in series and in parallel. To be more specific, four ionization catalyst groups 410, each of which has three ionization catalyst cartridges 411, may be provided. These four ionization catalyst groups 410 may be connected in combination of in series and in parallel, as depicted in FIG. 1(*b*).

As described above, as the plurality of ionization catalyst groups 410 are connected in series, the mixed oil is made to pass through the ionization catalyst groups 410 repeatedly by controlling an open-close control valve 406 installed at the front of the ionization catalyst groups 410.

In this manner, the mixed oil can be converted to the reformed fuel with higher efficiency by passing through the ionization catalyst groups 410 multiple times.

Meanwhile, the ionization catalyst may include, but not limited to, alumina, silica gel, germanium, magnesia, magnesium, titanium oxide, Tomuro stone, zeolite, lithium ore and vanadium as main components. By way of example, the ionization catalyst cartridge 411 may be implemented in the form of a pipe charged with a spherical catalyst containing, but not limited to, alumina, silica gel, germanium, magnesia, magnesium, titanium oxide, Tomuro stone, zeolite, lithium ore and vanadium as main components. For example, a diameter of the spherical catalyst may be, e.g., about 1 cm.

The multiplicity of ionization catalyst cartridges 411 may be classified into three kinds depending on which catalyst material is added to the main components of the ionization catalyst.

That is, the multiplicity of ionization catalyst cartridges 411 incorporated in each ionization may include a first ionization catalyst cartridge 411*a*, a second ionization catalyst cartridge 411*b* and a third ionization catalyst cartridge 411*c*.

By way of example, referring to FIG. 1(*b*) and FIG. 5, the ionization catalyst unit 400 may be comprised of four ionization catalyst groups 410 connected in combination of in series and in parallel, and each ionization catalyst group 410 includes three ionization catalyst cartridges 411*a*, 411*b* and 411*c*.

The mixed oil may be allowed to pass through the ionization catalyst group 410 in the order of the first ionization catalyst cartridge 411*a*, the second ionization catalyst cartridge 411*b* and then the third ionization catalyst cartridge 411*c*.

By way of example, referring to FIG. 5, the mixed oil may pass through the ionization catalyst groups 410 twice. That is, after the mixed oil may pass through a first ionization catalyst cartridge 411*a*, a second ionization catalyst cartridge 411 and a third ionization catalyst cartridge 411*c* of a first ionization catalyst group 410 in sequence, the mixed oil may then be made to pass through a first ionization catalyst cartridge 411*a*, a second ionization catalyst cartridge 411 and a third ionization catalyst cartridge 411*c* of a second ionization catalyst group 410 in sequence.

Further, the first ionization catalyst cartridge 411*a* serves to cause ionization of carbons included in the oil in the mixed oil. Through the ionization, adsorption of hydrogen in the water and the carbon in the oil can be facilitated.

An ionization catalyst accommodated in the first ionization catalyst cartridge 411*a* may be prepared by adding copper ions, silver ions, carbon ions and tourmaline to basic catalyst materials including alumina, silica gel, germanium, magnesia, magnesium, titanium oxide, Tomuro stone, zeolite, lithium ore and vanadium, and then by ceramizing the mixture. The ionization catalysts included in the first ionization catalyst cartridge 411*a* may be referred to as an ionizing catalyst.

The second ionization catalyst cartridge 411*b* serves to couple carbon components included in the oil in the mixed oil and hydrogen components in the water in the mixed oil. For example, the carbon components included in the oil in the mixed oil may be carbons ionized while passing through the first ionization catalyst cartridge 411*a*. Further, the hydrogen components included in the water in the mixed oil may be hydrogen ionized as the water in the water tank is pretreated as stated above.

An ionization catalyst accommodated in the second ionization catalyst cartridge 411*a* may be prepared by adding hydrogen ions, carbon ions and active oxygen species to the basic catalyst materials including alumina, silica gel, germanium, magnesia, magnesium, titanium oxide, Tomuro stone, zeolite, lithium ore and vanadium, and then by ceramizing the mixture. The ionization catalysts included in the second ionization catalyst cartridge 411*b* may be referred to as a hydrogenating catalyst.

The third ionization catalyst cartridge 411*c* serves to stabilize the mixed oil having passed through the first and second ionization catalyst cartridges 411*a* and 411*b*.

To stabilize the mixed oil, the third ionization catalyst cartridge 411*c* may serve to coat a molecular structure of the mixed oil obtained while the mixed oil passes through the second ionization catalyst cartridge 411*b*, thus allowing that molecular structure to be maintained.

An ionization catalyst accommodated in the third ionization catalyst cartridge 411*c* may be prepared by adding titanium powder to the basic catalyst materials including alumina, silica gel, germanium, magnesia, magnesium, titanium oxide, Tomuro stone, zeolite, lithium ore and vanadium, and then by ceramizing the mixture. The ionization catalysts included in the third ionization catalyst cartridge 411*a* may be referred to as a coating catalyst.

Finally, the mixed oil is converted to the reformed fuel while it passes through the ionization catalyst unit 400 as described above.

Figure 6:
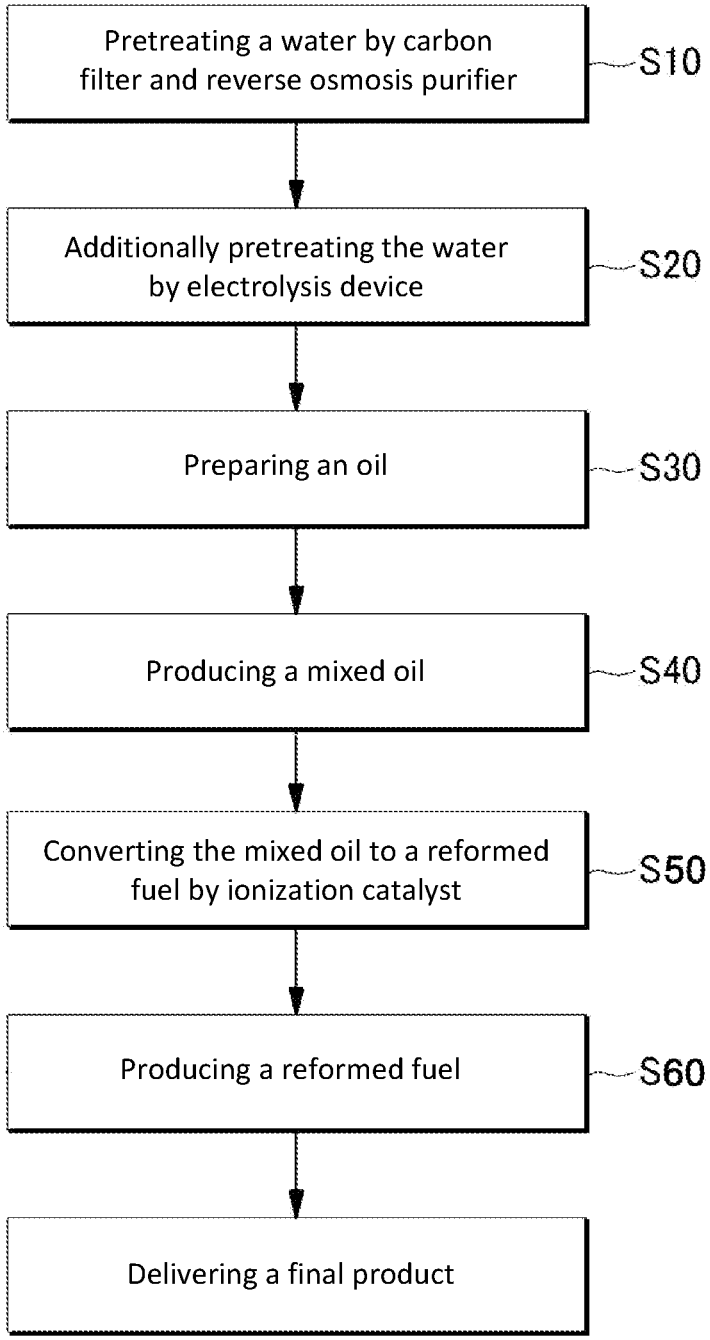

Now, by referring FIG. 6, a method for manufacturing a reformed fuel using vegetable oil in accordance with the present example embodiment (hereinafter, simply referred to as "the present reformed fuel manufacturing method") will be elaborated. The present reformed fuel manufacturing method is directed to producing the reformed fuel by using the present reformed fuel manufacturing apparatus as described above. Parts identical or similar to those described in the present reformed fuel manufacturing apparatus will be assigned the same reference numerals, and redundant description will be simplified or omitted.

The present reformed fuel manufacturing method includes block S10 for pretreating a water by a carbon filter and a reverse osmosis purifier equipped along an inlet of water supply line in a water tank unit 100.

The present reformed fuel manufacturing method further includes block S20 for additionally pretreating the water by an electrolysis device located inside a water tank.

The present reformed fuel manufacturing method further includes block S30 for preparing an oil by introducing the oil into an oil tank unit 200.

Further, the present reformed fuel manufacturing method includes block S40 for producing a mixed oil from the pretreated water introduced from the water tank unit 100 and the oil introduced from the oil tank unit 200 with an inline mixer supplied into a mixed oil unit 300.

Within the mixed oil unit 300, the pretreated water and the oil are further mixed with each other by being agitated in a mixed oil tank. Accordingly, the mixed oil can be uniformly maintained without being separated.

Further, the present reformed fuel manufacturing method further includes a block S50 for converting the mixed oil from the mixed oil unit 300 to a reformed fuel with an ionization catalyst supplied into an ionization catalyst unit 400.

As stated above, the ionization catalyst may be accommodated in the ionization catalyst unit 400. The ionization catalyst unit 400 may include one or more ionization catalyst groups 410, and each ionization catalyst group 410 may include the multiplicity of ionization catalyst cartridges 411. Since the ionization catalyst and the configuration/operation of the ionization catalyst unit 400 are already discussed in the description of the present reformed fuel manufacturing apparatus, detailed description thereof will be omitted.

The above description of the illustrative embodiments is provided for the purpose of illustration, and it would be understood by those skilled in the art that various changes and modifications may be made without changing technical conception and essential features of the illustrative embodiments. Thus, the above-described illustrative embodiments are illustrative in all aspects and do not limit the present disclosure. For example, each component described to be of a single type can be implemented in a distributed manner. Likewise, components described to be distributed can be implemented in a combined manner.

The scope of the inventive concept is defined by the following claims and their equivalents rather than by the detailed description of the illustrative embodiments. It shall be understood that all modifications and embodiments conceived from the meaning and scope of the claims and their equivalents are included in the scope of the inventive concept.

What is claimed is:

1. A reformed fuel manufacturing apparatus using a conventional oil, comprising:

a water tank unit configured to pretreat a water introduced therein by using a carbon filter and a reverse osmosis purifier;

wherein the water is additionally pretreated by applying voltage therein with an electrolysis device;

an oil tank unit configured to store an oil introduced from an oil inlet;

a mixed oil unit connected to the water tank unit and the oil tank unit and configured to produce a mixed oil by using an inline mixer; and, an ionization catalyst unit connected to the mixed oil unit and configured to convert the mixed oil to a reformed fuel.

2. The reformed fuel manufacturing apparatus of claim 1, wherein the water tank unit further includes:

a water supplying pump configured to introduce the water therein;

a water tank configured to receive the water through the water supplying pump and store the water temporarily; and, wherein the electrolysis device is submerged in the water inside the water tank.

3. The reformed fuel manufacturing apparatus of claim 1, wherein the water is pretreated when pH value is in the range of 6.0-6.5 and Oxidation Reduction Potential (ORP) value is in the range of −265~−275.

4. The reformed fuel manufacturing apparatus of claim 1, wherein the oil tank unit further includes: an oil supplying pump configured to introduce the oil therein; and, an oil tank configured to receive the oil through the oil supplying pump and store the oil temporarily.

5. The reformed fuel manufacturing apparatus of claim 1, wherein the mixed oil unit further includes:

a high-pressure water pump configured to transfer the pretreated water introduced from the water tank unit;

a high-pressure oil pump configured to transfer the oil introduced from the oil tank unit;

an inline mixer formed to Y shape and configured to receive the pretreated water through the high-pressure water pump and the oil through the high-pressure oil pump and generate the mixed oil; and a mixed oil tank configured to receive and store the mixed oil from the inline mixer temporarily.

6. The reformed fuel manufacturing apparatus of claim 5, wherein, the pretreated water passes through a control valve configured to adjust the amount of the pretreated water flow, a pressure gage configured to measure the pressure therein, and a flow gage configured to measure the flow rate therein, all of which are installed along a conduit line between the water tank and the inline mixer; and wherein, the oil passes through a control valve configured to adjust the amount of the oil flow, a pressure gage configured to measure the pressure therein, and a flow gage configured to measure the flow rate therein, all of which are installed along a conduit line between the oil tank and the inline mixer.

7. The reformed fuel manufacturing apparatus of claim 5, wherein, the inline mixer contains a multiple number of protrusions on an inner surface thereon to produce turbulence to the pretreated water introduced from the water tank and the oil introduced from the oil tank.

8. The reformed fuel manufacturing apparatus of claim 7, wherein, a main controller adjusts a ratio between the pretreated water and the oil using a control value based on measurements of the pressure gage and the flow gage respectively.

9. The reformed fuel manufacturing apparatus of claim 1, wherein the ionization catalyst unit further includes:

a mixed oil pump configured to transfer the mixed oil;

one or more ionization catalyst groups configured to receive the mixed oil through the mixed oil pump;

wherein each of the one or more ionization catalyst group comprises a plurality of ionization catalyst cartridges; and wherein each ionization catalyst cartridge accommodates therein an ionization catalyst.

10. The reformed fuel manufacturing apparatus of claim 9, wherein, the ionization catalyst groups are connected to each other in series or in combination of in series and in parallel for allowing the mixed oil to pass therethrough in sequence, and the number of catalyst groups are selected by an open-close control valve installed at the front of each ionization catalyst group.

11. The reformed fuel manufacturing apparatus of claim 10, wherein each of the plurality of ionization catalyst cartridges comprises:

a first ionization catalyst cartridge configured to cause ionization of carbon contained in the oil in the mixed oil;

a second ionization catalyst cartridge configured to cause a carbon component contained in the oil in the mixed oil to be coupled to a hydrogen component contained in the water in the mixed oil; and a third ionization catalyst cartridge configured to stabilize the mixed oil having passed through the first ionization catalyst cartridge and the second ionization catalyst cartridge.

12. The reformed fuel manufacturing apparatus of claim 11, wherein the mixed oil is allowed to pass through the first ionization catalyst cartridge, the second ionization catalyst cartridge and the third ionization catalyst cartridge in sequence.

13. The reformed fuel manufacturing apparatus of claim 12, wherein the ionization catalyst contains alumina, silica gel, germanium, magnesia, magnesium, titanium oxide, Tomuro stone, zeolite, lithium ore and vanadium as basic catalyst materials.

14. The reformed fuel manufacturing apparatus of claim 9, wherein the mixed oil pump feeds the mixed oil to the ionization catalyst groups at 0.5 MPa pressure.

15. A reformed fuel manufacturing method using a conventional oil, comprising:

preparing a pretreated water by a carbon filter and a reverse osmosis purifier located along an inlet of water supply;

Additionally pretreating the water by applying a voltage with an electrolysis device inside a water tank unit;

Preparing an oil by introducing it to an oil tank unit;

producing a mixed oil from the pretreated water introduced from the water tank unit and the oil introduced from the oil tank unit with an inline mixer; and, converting the mixed oil from the mixed oil unit to a reformed fuel with an ionization catalyst group.

* * * * *